US010070732B1

(12) United States Patent
Deng

(10) Patent No.: US 10,070,732 B1
(45) Date of Patent: Sep. 11, 2018

(54) AIR BAG MODULE OF INFLATABLE MATTRESS

(71) Applicant: TangTring Seating Technology Inc., Huizhou, Guangdong (CN)

(72) Inventor: Xing-Ming Deng, Guangdong (CN)

(73) Assignee: Tangtring Seating Technology Inc., Guangdong (CN)

( * ) Notice: Subject to any disclaimer, the term of this patent is extended or adjusted under 35 U.S.C. 154(b) by 0 days.

(21) Appl. No.: 15/454,717

(22) Filed: Mar. 9, 2017

(51) Int. Cl.
*A47C 27/08* (2006.01)
*A47C 27/10* (2006.01)
*A47C 27/18* (2006.01)

(52) U.S. Cl.
CPC ..... *A47C 27/081* (2013.01); *A47C 27/087* (2013.01); *A47C 27/10* (2013.01); *A47C 27/18* (2013.01)

(58) Field of Classification Search
CPC ..... A47C 27/08; A47C 27/081; A47C 27/10; A47C 27/128; A47C 27/18; A47C 27/14; A47C 27/087; A61G 7/05769; A61G 7/05776
See application file for complete search history.

(56) References Cited

U.S. PATENT DOCUMENTS 4,193,149 A * 3/1980 Welch ..... A61G 7/05776 5/713
4,803,744 A * 2/1989 Peck ..... A61B 5/1115 5/706
5,311,623 A * 5/1994 Hendi ..... A47C 27/081 5/685
5,367,728 A * 11/1994 Chang ..... A47C 27/082 5/615
5,564,142 A * 10/1996 Liu ..... A61G 7/05776 5/689
5,619,764 A * 4/1997 Lopau ..... A61G 7/05776 5/713
5,651,151 A * 7/1997 Schild ..... A61G 7/05776 5/710

(Continued)

FOREIGN PATENT DOCUMENTS

CN 201253034 Y 6/2009
TW M287094 U 2/2006
TW I414285 B 11/2013

*Primary Examiner* — Eric J Kurilla
(74) *Attorney, Agent, or Firm* — Muncy, Geissler, Olds & Lowe, P.C.

(57) ABSTRACT

An air bag module of inflatable mattress is disclosed. The inflatable mattress is provided with a lining for the air bag module to be placed therein, and a resilience supplying module being placed in the lining and resting on the air bag module. The air bag module includes at least one air bag unit. The air bag unit is provided with an air distribution layer and a hardness adjustment layer connected with the air distribution layer while located between the air distribution layer and the resilience supplying module. In the air distribution layer, air is inputted into each distributing air bag equally via intercommunication of distributing air bags, such that air from the distributing air bags is consistently received by each supporting air bag of the hardness adjustment layer. Thus, the problem of uneven surface of bed due to non-uniform inflation in the conventional structure is solved.

8 Claims, 6 Drawing Sheets

(56) References Cited

U.S. PATENT DOCUMENTS

| | | | | | |
|---|---|---|---|---|---|
| 5,666,681 | A * | 9/1997 | Meyer | A61G 7/05769 | 5/624 |
| 5,727,270 | A * | 3/1998 | Cope | A47C 27/081 | 141/114 |
| 5,740,573 | A * | 4/1998 | Boyd | A47C 27/081 | 5/685 |
| 5,794,289 | A * | 8/1998 | Wortman | A61G 7/001 | 5/423 |
| 5,918,336 | A * | 7/1999 | Lee | A61G 7/05776 | 5/706 |
| 6,073,290 | A * | 6/2000 | Miller, Sr. | A61G 7/05776 | 5/710 |
| 6,148,461 | A * | 11/2000 | Cook | A61G 7/05769 | 5/706 |
| 7,814,593 | B2 * | 10/2010 | Attila | A47C 27/082 | 5/710 |
| 8,104,126 | B2 * | 1/2012 | Caminade | A61G 7/05776 | 5/655.3 |
| 2004/0107503 | A1 * | 6/2004 | Tu | A47C 27/082 | 5/710 |
| 2004/0226103 | A1 * | 11/2004 | Reger | A61G 7/05753 | 5/713 |
| 2013/0146216 | A1 * | 6/2013 | Mileti | B29D 22/02 | 156/197 |

* cited by examiner

AIR BAG MODULE OF INFLATABLE MATTRESS

FIELD OF THE INVENTION

The present invention is related to an air bag module of inflatable mattress, particularly to a uniformly inflatable air bag module.

BACKGROUND OF THE INVENTION

Nowadays, as technology develops highly, quality requirements for food, clothing, housing, transportation, education, and entertainment are increased day after day. It may be found that, in terms of "housing", a mattress placed therein with air bags for adjusting the hardness provided by companies is nowadays presented on the market in addition to a general mattress constituted by a sponge.

An air bed is disclosed in Taiwan patent no. M287094. The air bed includes an air mat body, two air transmission tubes and an inflating/deflating device. The air mat body is provided with several tubes. The inflating/deflating device may be allowed for inflating/deflating the tubes via the two air transmission tubes alternately.

Additionally, an air mattress is also disclosed in Taiwan patent no. 1414285. The air mattress includes a base mattress layer, a first air mattress layer, a second air mattress layer and an air pump. The base mattress layer is provided with a plurality of first air cells communicated with one another. The first air mattress layer is provided with a plurality of second air cells communicated with one another. The second air mattress layer is provided with a plurality of third air cells communicated with one another. In this case, the first air cell, the second air cell and the third air cell are of different widths. The air pump is allowed for inflating the first air cells, the second air cells and the third air cells, respectively.

In addition, a multilayered inflatable bed is further disclosed in China patent publication no. CN201253034. The multilayered inflatable bed includes a bed body. The bed body is provided with a top wall, a bottom wall, a surrounding wall, an intermediate layer and a plurality of cavities. In this case, the cavities are divided into a plurality of upper cavities and a plurality of lower cavities. The connection between the upper cavity and the lower cavity is formed by an air hole.

However, in respect of the technical contents of above three patents, it is found that, in patent no. M287094, the tubes are incapable of being inflated equally because they are inflated/deflated by the inflating/deflating device alternately. Moreover, in patent no. I414285, the first air cell, the second air cell and the third air cell are incapable of being inflated equally because they are not communicated with one another. Further, in patent no. CN201253034, inflation volume in sections of the upper cavity and the lower cavity are inconsistent because the upper cavity and the lower cavity are merely communicated via the air hole only. It is apparent that all of the mattresses of patents no. M287094, I414285 and CN201253034 are incapable of keeping surfaces of beds even, and further, users lying on these mattresses are uncomfortable, as a result of non-uniform inflation.

SUMMARY OF THE INVENTION

It is the main object of the present invention to solve the problem of uneven surface of bed due to non-uniform inflation in the conventional structure.

For achieving the above object, the present invention provides an air bag module of inflatable mattress, the inflatable mattress being provided with a lining provided for the air bag module to be placed therein, and a resilience supplying module being placed in the lining and resting on the air bag module, the air bag module including at least one air bag unit. The air bag unit is provided with an air distribution layer and a hardness adjustment layer connected with the air distribution layer while located between the air distribution layer and the resilience supplying module. The air distribution layer is provided with at least two distributing air bags side-by-side disposed while communicated with one another so as to be connected to an inflating device for receiving air together, and a plurality of first air-guiding portions disposed along the connection between the two distributing air bags. The hardness adjustment layer is provided with a plurality of supporting air bags not communicated with one another while disposed on the surfaces of the two distributing air bags, and a plurality of second air-guiding portions, respectively provided on the surface of one of the supporting air bags so as to be communicated with one of the first air-guiding portions.

In one embodiment, the air distribution layer is provided with a plurality of first connection lines provided, at an interval between each other, on the connection between the two distributing air bags, each of the first air-guiding portions being provided between any two adjacent first connection lines so as to be communicated with the two distributing air bags, respectively.

In one embodiment, the air distribution layer is provided with an air delivery tube provided at one end of each of the distributing air bags and communicated with the distributing air bags, as well as allowed to connect to said inflating device.

In one embodiment, the hardness adjustment layer is provided with a plurality of second connection lines, respectively provided on the connection between any two adjacent supporting air bags, so as to isolate the any two adjacent supporting air bags.

In one embodiment, each of the second air-guiding portions is located at the center of the surface of one of the supporting air bags, respectively.

In one embodiment, each of the first air-guiding portions is a first air-guiding hole, while each of the second air-guiding portions is a second air-guiding hole communicated with one of the first air-guiding holes, respectively.

In one embodiment, each of the distributing air bags is presented in the form of a long strip and arranged to form a rectangular pattern. Each of the supporting air bags is presented in the shape of a rectangle, while these supporting air bags are connected together to form a rectangular pattern of the shape the same as that formed by the distributing air bags after being arranged.

In one embodiment, the resilience supplying module is provided with a plurality of elastic bodies, as well as the lining is provided with a plurality of lattice-like units arranged in parallel with one another, each lattice-like unit defining a mounting space provided for at least one of the air bag units and at least one of the elastic bodies to be placed therein in turn.

In light of above embodiments, the present invention is provided with features, in comparison with the convention art, as follows.

In the present invention, in the air distribution layer, air is inputted into each of the distributing air bags equally via intercommunication with one another of the distributing air bags, in such a way that air coming from the distributing air bags is consistently received by each of the supporting air bags of hardness adjustment layer independent of one another. Thereby, in the process of adjustment of hardness, the inflatable mattress may be inflated consistently and evenly. Further, the problem of uneven surface of bed due to non-uniform inflation in the conventional structure is solved.

DETAILED DESCRIPTION OF THE PREFERRED EMBODIMENTS

The detailed description and technical content of the present invention will now be described in combination with drawings as follows.

Figure 1:
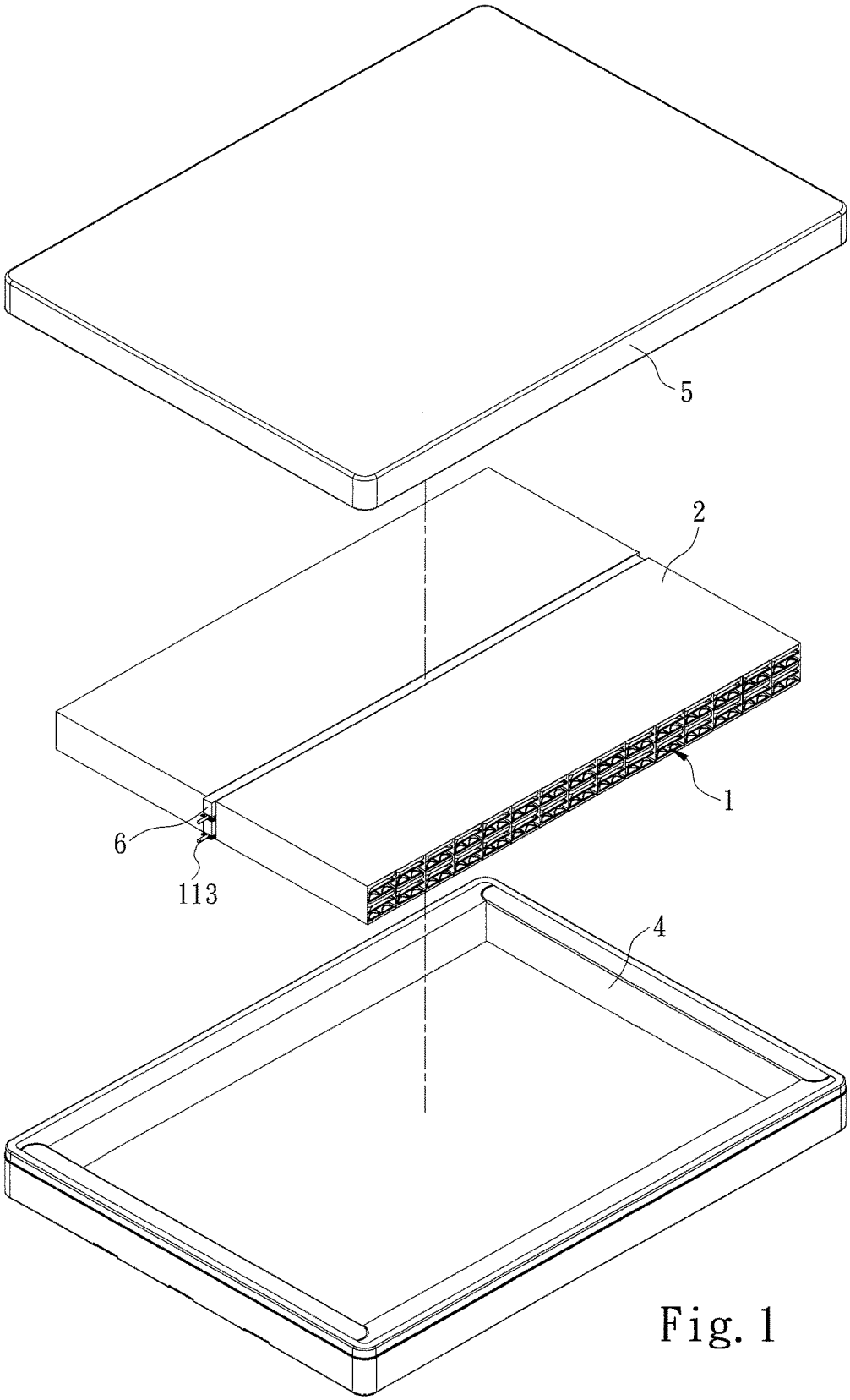
FIG. 1 is an exploded perspective diagram when the present invention is put into use.
Figure 2:
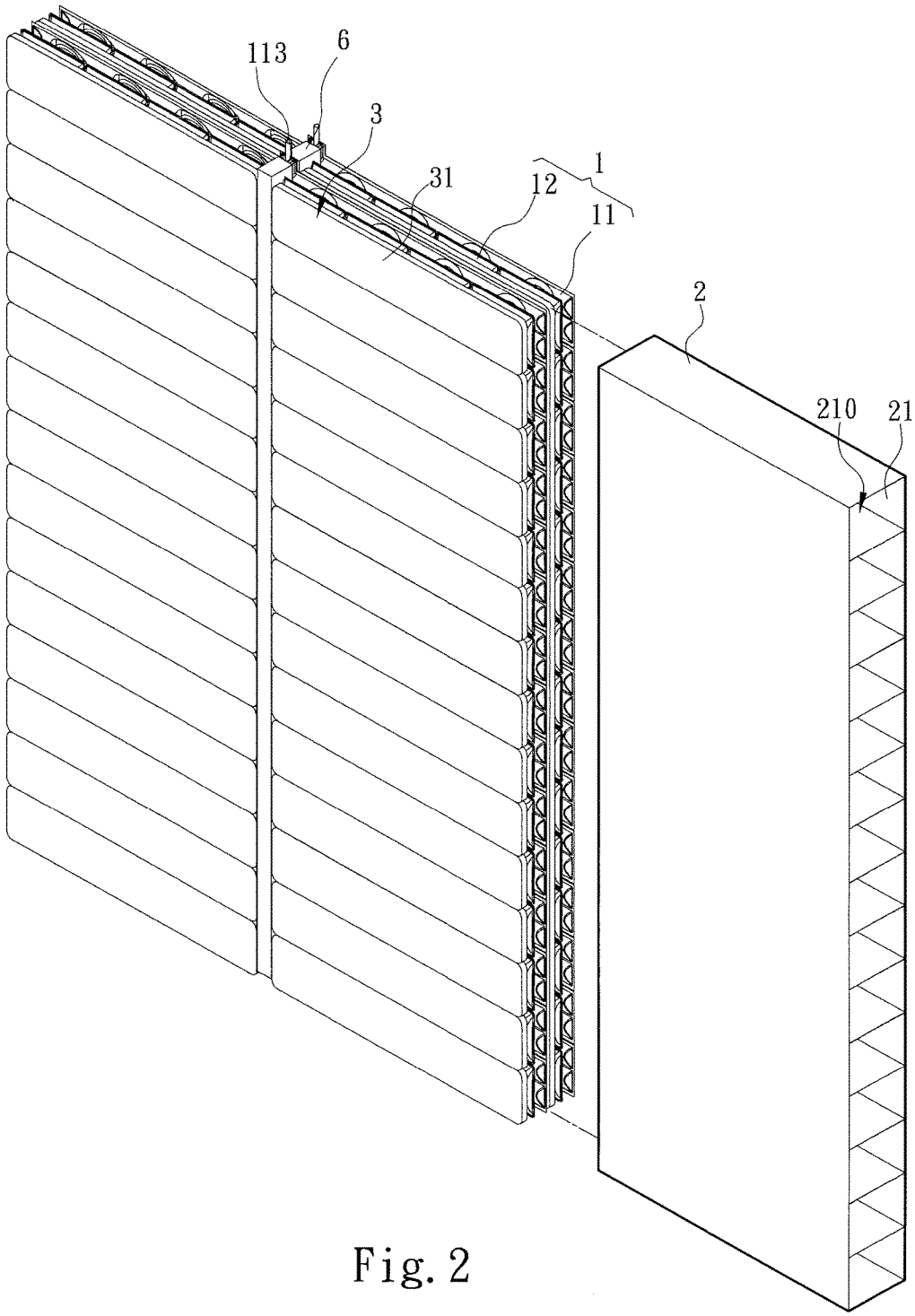
FIG. 2 is a partial exploded diagram (I) when the present invention is put into use.
Figure 3:
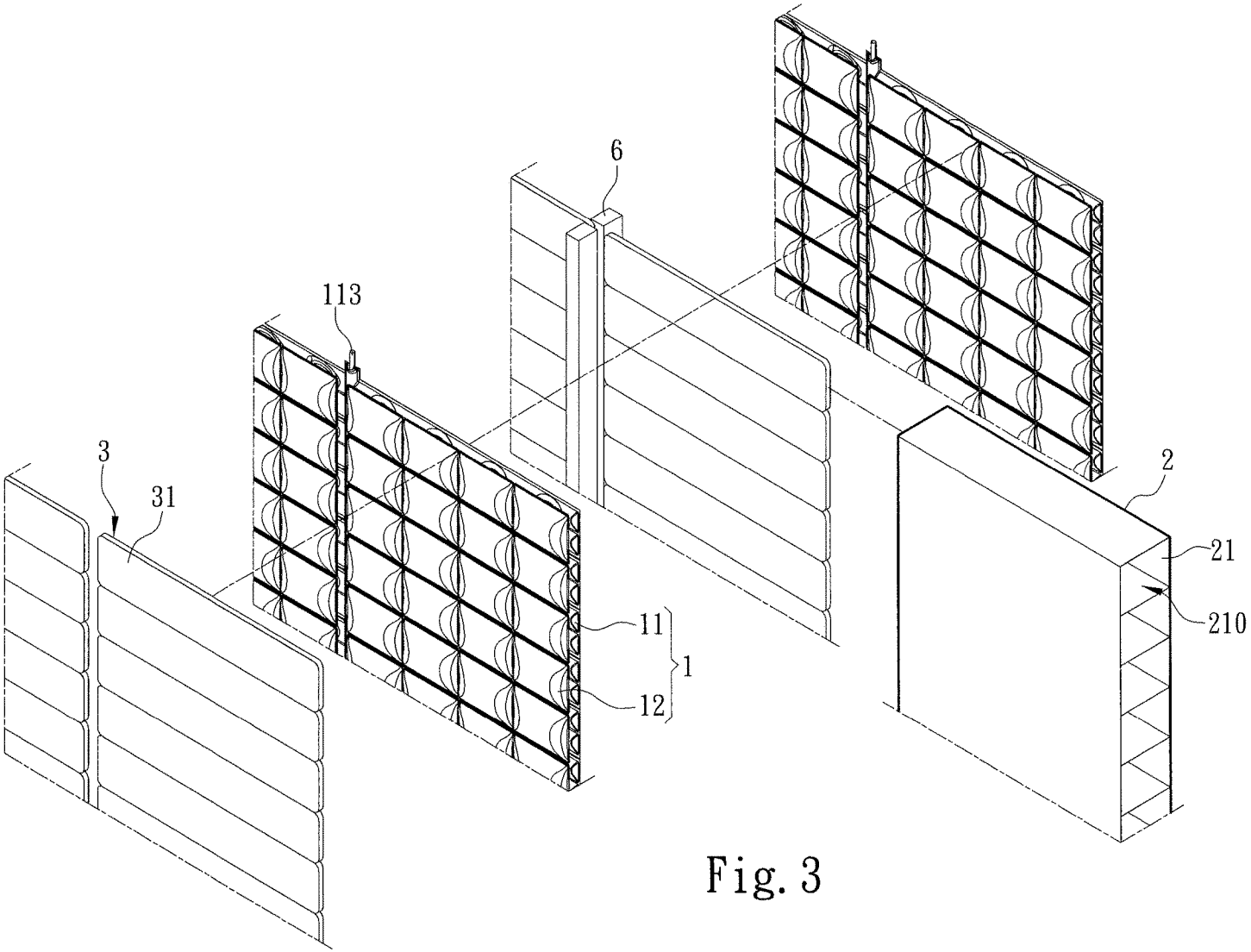
FIG. 3 is a partial exploded diagram (II) when the present invention is put into use.
Figure 4:
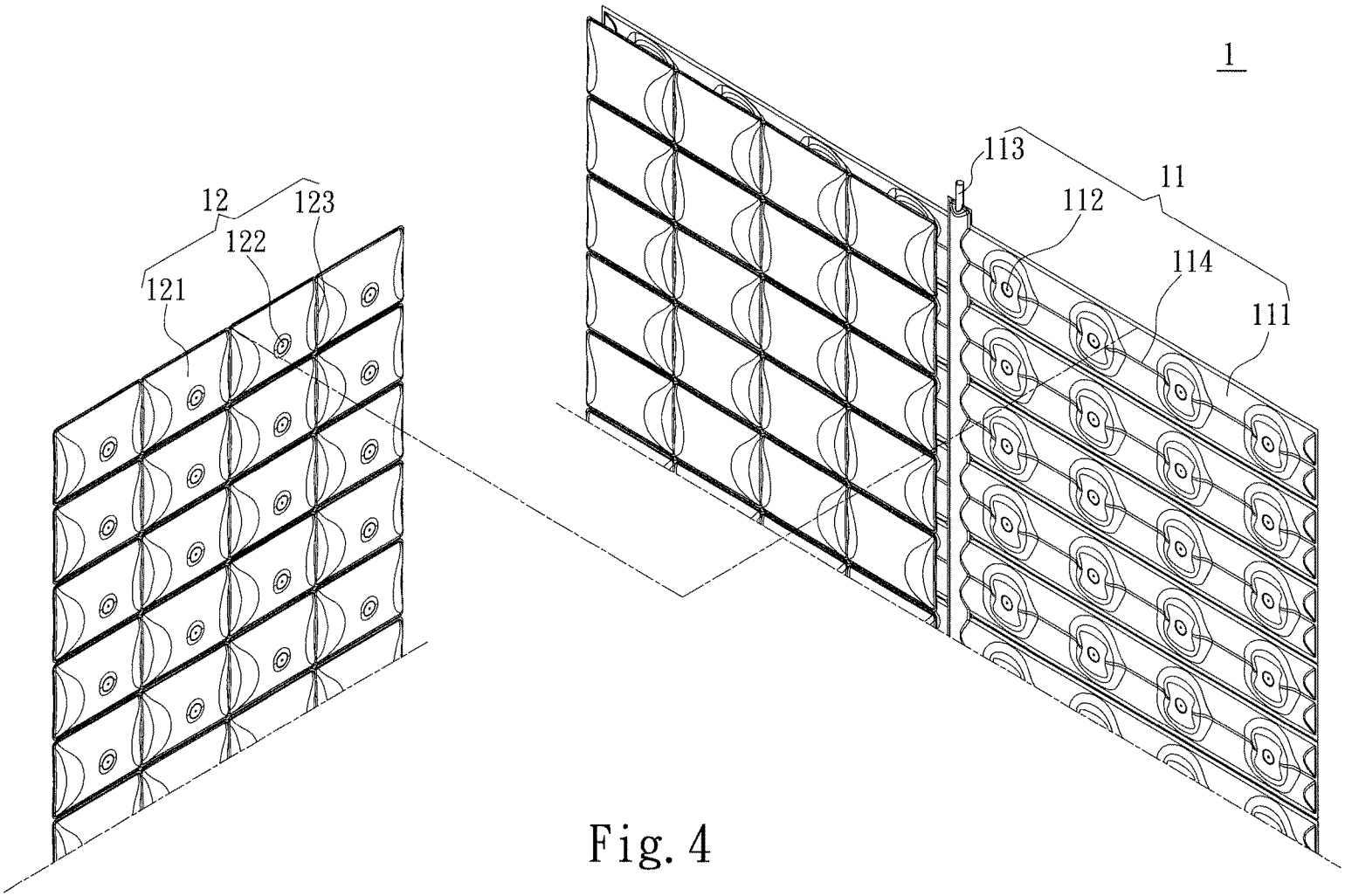
FIG. 4 is an exploded diagram of the present invention.

Referring to FIGS. 1 to 4, the present invention provides an air bag module of inflatable mattress, the inflatable mattress including a lining 2 and a resilience supplying module 3 (for example, a sponge mat). Moreover, the air bag module and the resilience supplying module 3 may be placed in the lining 2 so as to form the inflatable mattress. Specifically, the air bag module includes at least one air bag unit 1, the air bag unit 1 being provided with an air distribution layer 11 and a hardness adjustment layer 12. The hardness adjustment layer 12 and the air distribution layer 11 are connected and stacked, as illustrated in FIG. 4. In this case, the air distribution layer 11 is provided with at least two distributing air bags 111 side-by-side disposed while communicated with one another, and a plurality of first air-guiding portions 112 disposed, along the connection between the two distributing air bags 111, at an interval between each other. In one embodiment, the air distribution layer 11 is provided with an air delivery tube 113, as illustrated in FIGS. 3 and 4. The air delivery tube 113 is provided at one end of each distributing air bag 111, so as to be communicated with the distributing air bags 111. In addition, the hardness adjustment layer 12 is provided with a plurality of supporting air bags 121 connected but not communicated with one another, and a plurality of second air-guiding portions 122, each second air-guiding portion 122 being provided in one of the supporting air bags 121, respectively. In one embodiment, each second air-guiding portion 122 is located at the center of the surface of one of the supporting air bags 121, respectively. Furthermore, the supporting air bags 121 are provided on the surfaces of the two distributing air bags 111, while each second air-guiding portion 122 is communicated with one of the first air-guiding portions 112, respectively. In one embodiment, each first air-guiding portion 112 is a first air-guiding hole, while each second air-guiding portion 122 is a second air-guiding hole communicated with one of the first air-guiding holes, respectively. In addition, each distributing air bag 111 may be presented in the form of a long strip and arranged to form a rectangular pattern, respectively. Each of the supporting air bags 121 may be presented in the shape of a rectangle, respectively, while these supporting air bags 121 are connected together to form a rectangular pattern of the shape the same as that formed by the distributing air bags 111 after being arranged, as illustrated in FIG. 4.

In the above paragraph, the fundamental embodied structure of the air bag module has been expounded clearly. Subsequently, the operation process and the embodied pattern created in the course of operation of the air bag module will be described for the present invention. In this connection, referring to FIGS. 1 to 4 again, the air bag module and the resilience supplying module 3 are put into the lining 2 in turn during the operation process of the air bag module, such that the air bag module is allowed to bear the resilience supplying module 3 at the bottom thereof; that is to say, the hardness adjustment layer 12 is located between the air distribution layer 11 and the resilience supplying module 3. Further, the number of each of the air bag module, the air bag unit 1, the lining 2 and the resilience supplying module 3 may be more than one in the implementation (as illustrated in FIGS. 1 and 2), while the combined air bag modules, the linings 2 and the resilience supplying module 3 are placed between a base plate 4 and a mattress body 5, such that an air bed is formed of the air bag modules, the linings 2, the resilience supplying module 3, the base plate 4 and the mattress body 5 integrally, as illustrated in FIG. 1. In one embodiment, the air bag module is provided with a plurality of the air bag units 1, and the resilience supplying module 3 is provided with a plurality of the elastic bodies 31 (such as, elastic sponges, for example), as well as the lining 2 is provided with a plurality of lattice-like units 21 arranged in parallel with one another, each lattice-like unit 21 defining a mounting space 210 therein, each mounting space 210 being provided for at least one of the air bag units 1 and at least one of the elastic bodies 31 to be placed therein, respectively.

Figure 5:
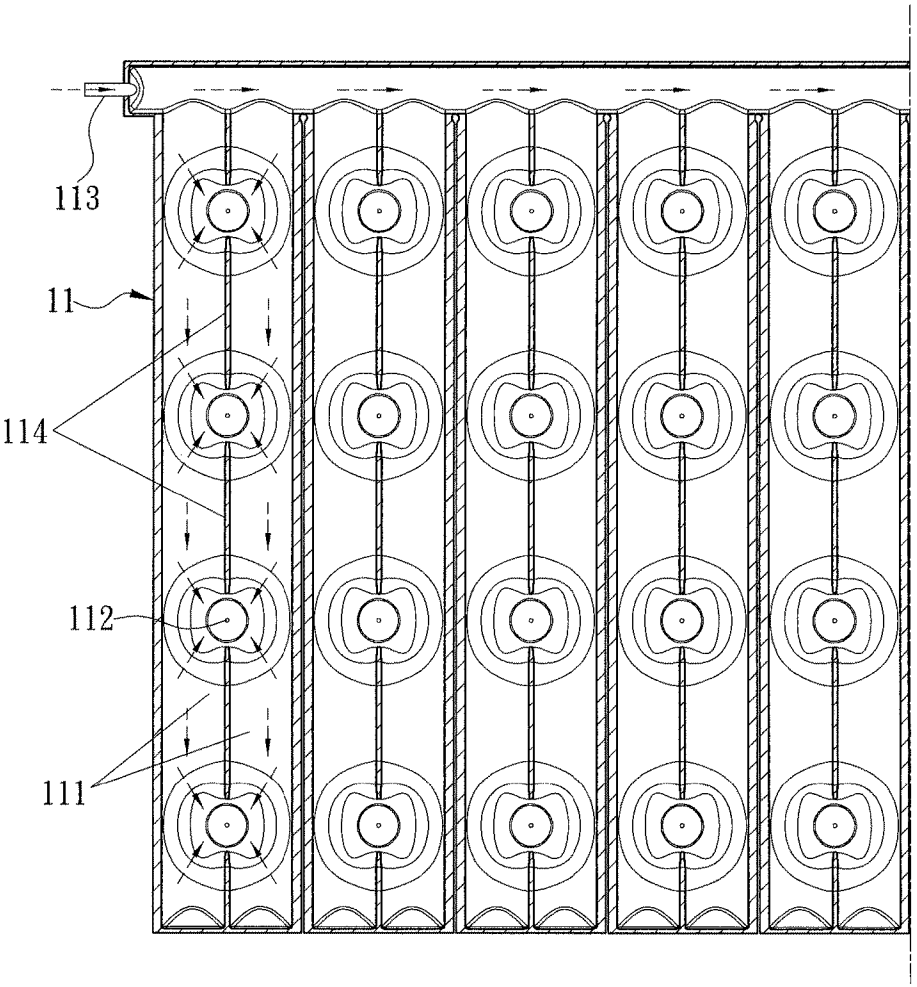
FIG. 5 is a top diagram of an air distribution layer of the present invention.
Figure 6:
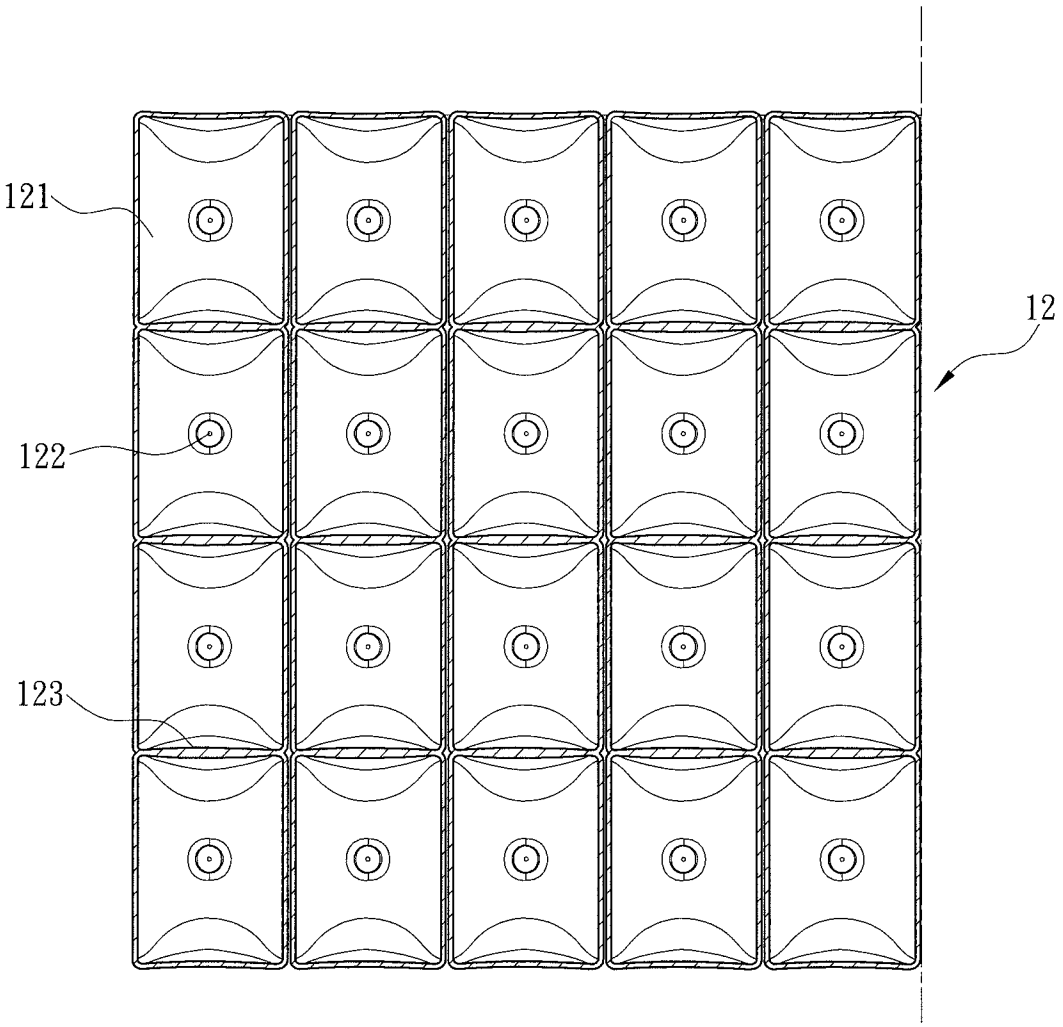
FIG. 6 is a bottom diagram of a hardness adjustment layer of the present invention.

Here, for facilitating the explanation of detailed variation of the air bag module in the practical use, the relationship among only one single air bag unit 1 and other components will be described in the following paragraphs. In detail, primary hardness is provided by the resilience supplying module 3 for the hardness of the inflatable mattress when the air bag unit 1 is uninflated. At this time, the lowest hardness of the inflatable mattress is perceived by a user lying on the mattress body 5. If increasing the hardness of the mattress is desired, an inflating device (not shown in the figures) may be connected to the air delivery tube 113 by the user, so as to inject air into the supporting air bag 121 through the inflating device. In one embodiment, the inflatable mattress is further provided with a filler strip 6 (such as, a sponge strip, for example) located above the air delivery tube 113. When the air bag unit 1 is being inflated, air is injected into each supporting air bag 121 from the two distributing air bags 111 through the first air-guiding portions 112 and the second air-guiding portions 122 (as illustrated in FIGS. 5 and 6). In this way, expanded volume and increased hardness may be then generated for each supporting air bag 121 owing to injected air. Thereby, the hardness of the inflatable mattress may be adjusted by users via the inflating device depending upon their own requirements. In this case, it should be noted that distribution of air and adjustment of hardness are performed by the air distribution layer 11 and the hardness adjustment layer 12 separately in the air bag unit 1 of the present invention. In the air distribution layer 11, air is inputted into each of the distributing air bags 111 equally via intercommunication with one another of the distributing air bags 111, in such a way that air coming from the distributing air bags 111 is consistently received by each supporting air bag 121 of hardness adjustment layer 12 independent of one another. Thus, in the process of adjustment of hardness, the inflatable mattress may be inflated consistently and evenly. Thereby, the problem of uneven surface of bed due to non-uniform inflation in the conventional structure is solved.

Then, for the purpose of inflating the air bag unit 1 more evenly, the air distribution layer 11 is further provided with a plurality of first connection lines 114 (for example, welding lines, i.e., fusion regions formed due to welding) in one embodiment as illustrated in FIGS. 4 and 5. The first connection lines 114 are provided, at an interval between each other, on the connection between the two distributing air bags 111, so as to isolate the two distributing air bags 111 from each other. Each first air-guiding portion 112 is provided between any two adjacent first connection lines 114, respectively. Accordingly, the first connection lines 114 are allowed for separating the two distributing air bags 111 from each other substantially in the air distribution layer 11, such that air is inputted into each of the two distributing air bags 111 equally. Furthermore, the hardness adjustment layer 12 is further provided with a plurality of second connection lines 123 (for example, welding lines, i.e., fusion regions formed due to welding), as illustrated in FIGS. 4 and 6. The second connection lines 123 are provided on the connection between any two adjacent supporting air bags 121, respectively, so as to isolate these two adjacent supporting air bags 121. Thus, expansion deformation generated on the edge of each supporting air bag 121 when air is injected may be avoided via one of the second connection lines 123, respectively.

What is claimed is:

1. An inflatable mattress, comprising:

an air bag module, including at least one air bag unit, said at least one air bag unit being provided with an air distribution layer and a hardness adjustment layer connected with said air distribution layer, said air distribution layer being provided with at least two distributing air bags and a plurality of first air-guiding portions, wherein said at least two distributing air bags are disposed side-by-side and communicate with each other, and said plurality of first air-guiding portions are disposed along a junction between said two distributing air bags, said hardness adjustment layer being provided with a plurality of supporting air bags wherein said plurality of supporting air bags are disposed on the surfaces of said two distributing air bags and do not communicate with each other, and the surface of each of said plurality of supporting air bags is provided with a second air-guiding portion which is communicated with one of said plurality of first air-guiding portions;

a resilience supplying module, disposed on said hardness adjustment layer of said at least one air bag unit, and supported by said air bag module; and a lining, provided for said air bag module and said resilience supplying module to be placed therein.

2. The inflatable mattress according to claim 1, wherein said air distribution layer is provided with a plurality of first connection lines which is disposed on the junction of said two distributing air bags, and said plurality of first connection lines are spaced apart from each other, and each of said plurality of first air-guiding portions is placed on one of said plurality of first connection lines and communicates with said two distributing air bags which is adjacent to said two distributing air bags.

3. The inflatable mattress according to claim 1, wherein said air distribution layer is provided with an air delivery tube, which is located at one end of said plurality of distributing air bags and communicate with said plurality of distributing air bags, and said air delivery tube is connected to an inflating device.

4. The inflatable mattress according to claim 1, wherein said hardness adjustment layer is provided with a plurality of second connection lines, which is located on the junction of any two of said adjacent supporting air bags to isolate said any two adjacent supporting air bags.

5. The inflatable mattress according to claim 1, wherein each of said plurality of second air-guiding portions is located at the center of the surface of one of said plurality of supporting air bags.

6. The inflatable mattress according to claim 1, wherein each of said plurality of first air-guiding portions is a first air-guiding hole, while each of said plurality of second air-guiding portions is a second air-guiding hole communicating with one of said plurality of first air-guiding holes.

7. The inflatable mattress according to claim 1, wherein each of said plurality of distributing air bags is presented in the form of a long strip and arranged to form a rectangular pattern, and each of said plurality of supporting air bags is presented in the shape of a rectangle, while said plurality of supporting air bags are connected together to form a rectangular pattern with the same shape as the pattern of said plurality of distributing air bags after being arranged.

8. The inflatable mattress according to claim 1, wherein said resilience supplying module is provided with a plurality of elastic bodies, and said lining is provided with a plurality of lattice-like units arranged in parallel with one another, each of said plurality of lattice-like units defines a mounting space, which is provided for at least one of said air bag units and at least one of said elastic bodies to be placed therein.

* * * * *